United States Patent [19]

Pelsy

[11] 4,103,443

[45] Aug. 1, 1978

[54] LINKAGE FOR AN EXCAVATING TOOTH

[76] Inventor: Gilles Pelsy, Domaine de l'Epina, Maucourt-sur-Orne, France, 55400

[21] Appl. No.: 783,465

[22] Filed: Mar. 31, 1977

[30] Foreign Application Priority Data

Apr. 6, 1976 [FR] France ..... 76 09979

[51] Int. Cl.[2] ..... A01B 13/08; E02F 5/18

[52] U.S. Cl. ..... 37/193; 172/484; 172/699; 280/460 A; 280/461 A

[58] Field of Search ..... 37/193; 172/484, 483, 172/464, 699, 700, 239, 444, 448, 439, 417, 4; 280/460 A, 461 A, 460 R, 461 R, 498, 456 A

[56] References Cited

U.S. PATENT DOCUMENTS

| | | | |
|---|---|---|---|
| 2,822,738 | 2/1958 | Smith | 172/239 |
| 2,924,285 | 2/1960 | Du Shane et al. | 172/444 X |
| 3,870,106 | 3/1975 | Gosling et al. | 172/239 |

FOREIGN PATENT DOCUMENTS

| | | | |
|---|---|---|---|
| 885,018 | 7/1953 | Fed. Rep. of Germany | 172/239 |
| 17,485 | 9/1956 | Fed. Rep. of Germany | 172/239 |
| 1,113,327 | 8/1961 | Fed. Rep. of Germany | 172/448 |

*Primary Examiner*—Clifford D. Crowder
*Attorney, Agent, or Firm*—Fulwider, Patton, Rieber, Lee & Utecht

[57] ABSTRACT

Drainage machine apparatus having a structure and a working equipment comprising a ground-engaging tooth mounted on a support and a system of arms connecting the support to the structure. The system of arms comprises first, second and third arms forming with the support a quadrilateral with the articulation of the first arm to the support, to the second arm and to the structure, the second arm to the third arm and the third arm to the support by inter-articulated fourth and fifth arms. The fourth arm is articulated to the third arm, the fifth arm to the structure and by a hydraulic jack coupled to the third and fourth arms.

5 Claims, 4 Drawing Figures

LINKAGE FOR AN EXCAVATING TOOTH

BACKGROUND OF THE INVENTION

The laying of drains in the ground is generally performed by machines having a movable structure of the bulldozer type and a tooth which penetrates into the ground and which is drawn by the said structure.

The most advanced of these machines have a device for coupling the tooth to the structure, which is deformable and permits the tooth to maintain a substantially constant direction and average depth, whilst the movable structure follows local unevennesses, bumps or depressions in the ground.

The known coupling device comprises a tooth support which slides in a slide with which the structure is equipped. The considerable stresses to which the slide is subjected lead to frequent breaking and a lack of stability.

BRIEF SUMMARY OF THE INVENTION

The problem of the invention is to obviate the abovementioned deficiencies.

According to the invention, this problem is solved by a drainage machine constituted by a structure and by working equipment comprising a breaking up tooth mounted on a support and a system of arms articulated about horizontal shafts connecting the supports to the structure, whereby the system of arms is formed by first, second and third arms which, in cooperation with the tooth support form an articulated quadrilateral, such as a parallelogram, the first arm being articulated to the support and to the second arm, the second arm being also articulated to the third arm and the third arm also being articulated to the support.

The second arm is separate from the structure, whilst the first arm is articulated to the structure by a different shaft to that which articulates it to the second arm and the system of arms also comprises fourth and fifth interarticulated arms, whereby additionally the fourth arm is articulated to the third arm and the fifth arm to the structure and a locking member, such as a hydraulic jack coupled to the third and fourth arms in such a way as to selectively maintain at a given value the angle formed by the third and fourth arms.

The following arrangements are often preferred:

The distances between the articulation shafts of on the one hand the first arm to the support and to the structure and on the other hand the fifth arm to the fourth arm and to the structure are substantially identical.

A further locking member, such as a hydraulic jack is coupled between the structure and the fifth arm in such a way as to maintain selectively constant the relative orientation of the fifth arm relative to the structure.

The structure is formed in two parts, a chassis and a hinge member which pivots about a shaft which is generally vertical relative to the chassis, whilst the first and fifth arms are articulated to the said hinge member.

BRIEF DESCRIPTION OF THE DRAWINGS

The invention will be better understood from the following description and claims and is illustrated in the accompanying drawings showing preferred embodiments of the present invention. In the drawings show:

DETAILED DESCRIPTION OF THE PREFERRED EMBODIMENTS

Figure 1:
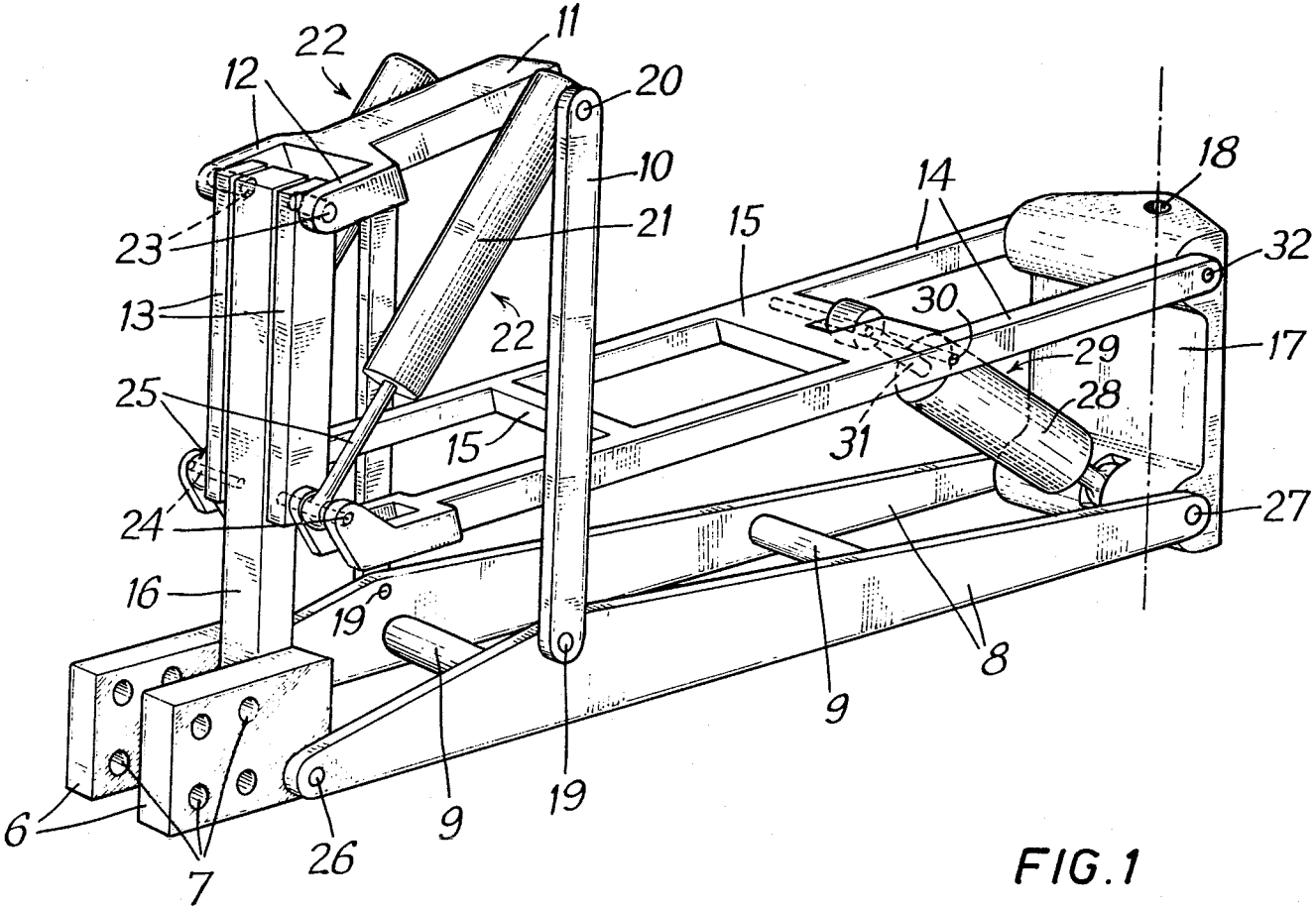
FIG. 1 a perspective view of the working equipment of a machine according to the invention.
Figure 2:
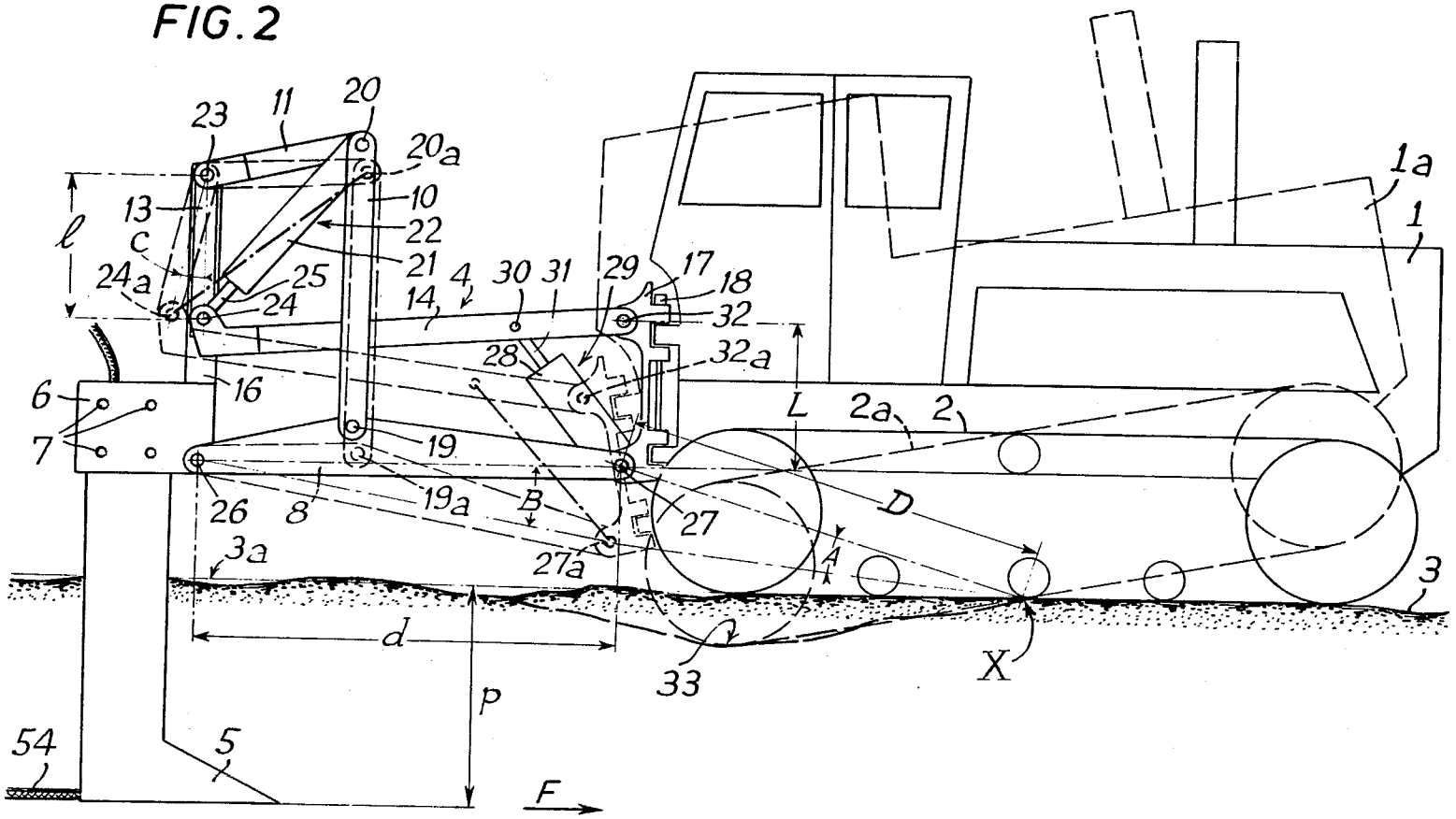
FIG. 2 an elevation of the machine according to the invention fitted with the equipment of FIG. 1.

The machine shown in FIGS. 1 and 2 comprises a chassis 1, whose caterpillars 2 rest on the ground 3 and working equipment 4 comprising a breaking up/excavating tooth 5, its support 6 and a system of arms connecting tooth 5 to chassis 1. Tooth 5 is fixed to its support 6 by detachable pins 7 which permit a position regulation. It is maintained in a working position and at a depth *p* from the average ground surface level 3*a* and is oriented in a direction F, said level and said direction being substantially constant in view of the system of connecting arms described hereinafter.

This system of arms comprises a first arm 8 having two longitudinal members joined by spacers 9, two second arms 10, a third arm 11, whereof one end is shaped to form a fork having two branches 12, two fourth arms 13, a fifth arm 14 having two longitudinal members interconnected by spacers 15, an extension 16 of tooth support 6 which is integral with the latter and a hinge member 17 which is mounted on chassis 1 so as to pivot about a vertical shaft 18.

These members are articulated together by horizontal articulation shafts.

Thus, the first, second, third arms, support 6 and extension 16 of the tooth support form a deformable parallelogram of shafts 19 connecting arms 10 to arms 9, shafts 20 connecting arms 10 to arm 11 and to cylinders 21 of two jacks 22, shafts 23 each connecting one branch 12 of arm 11 to one of the arms 13, shafts 24 each connecting one end of one of the longitudinal members constituting arm 14 to the second end of an arm 13 and to the end of piston rod 25 of a jack 22 and a shaft 26 connecting support 6 to the two longitudinal members of arm 8. A shaft 27 connects the two longitudinal members of arm 8 to hinge member 17 and to cylinder 28 of a jack 29, a shaft 30 connects the piston rod 31 of jack 29 to one of the spacers 15 of arm 14 and a shaft 32 connects one end of the longitudinal members of arm 14 to hinge members 17.

FIG. 2 shows a second position 2*a* of the caterpillar and 1*a* of the structure, whereby caterpillars 2*a* have gone into a depression without the depth *p* and direction F of the tooth having changed. With jacks 22 locked but jack 29 completely free, the various shafts have arrived in new positions 19*a*, 20*a*, 24*a*, 27*a*, 32*a*. Only shafts 23 and 26 connected to tooth support 6 and to its extension 16 which have not moved have themselves remained stationary.

Figure 4:
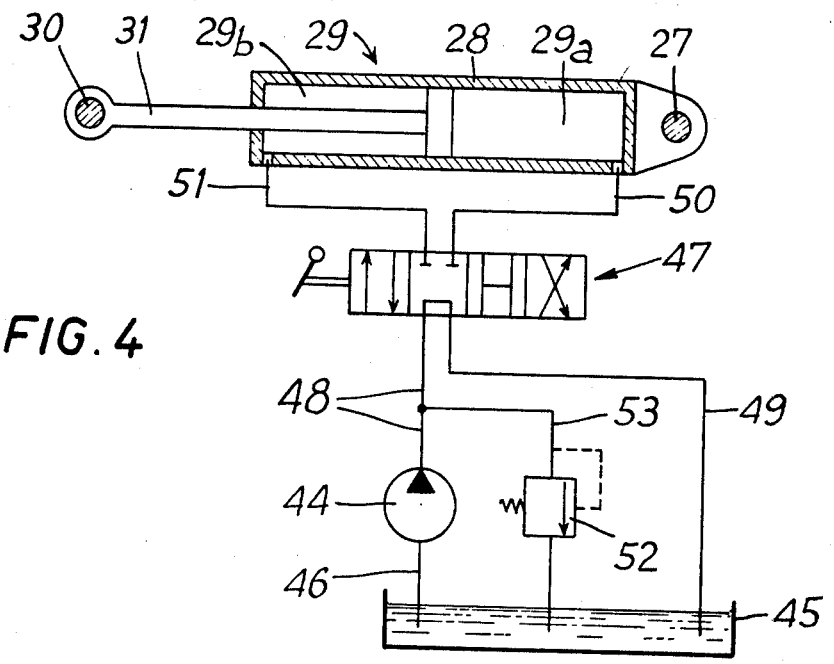
FIGS. 3 and 4 hydraulic circuit diagrams for controlling the jacks of the working equipment of FIG. 1.
Figure 3:
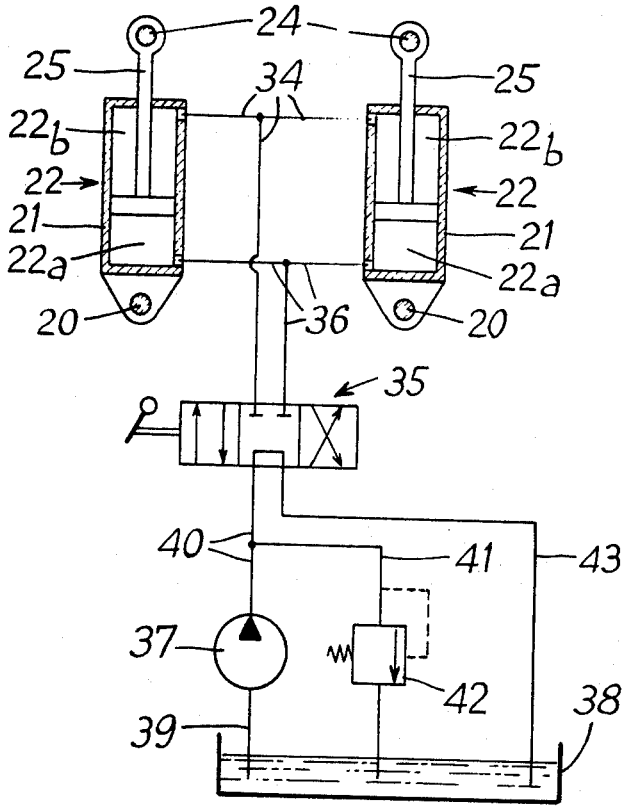

The supply circuits for jacks 22 and 29 are shown in FIGS. 3 and 4.

The two jacks 22 have their large chambers 22*a* connected in parallel by pipes 36 connected to a three-position valve 35. The small chamber 22*b* of jacks 22 are also connected in parallel by pipes 34 connected to valve 35. A pump 37 is connected to a fluid reservoir 38 by its suction pipe 39 and to valve 35 by its delivery pipe 40. A calibrated delivery valve 42 is provided on pipe 41 joined to pipe 40 and connected to reservoir 38, whilst a pipe 43 connects valve 35 to reservoir 38.

The first position of valve 35 corresponds to connecting pipes 34 and 40 and pipes 36 and 43, the second position to connecting pipes 40 and 43 and the sealing of pipes 34 and 36 and the third position to connecting pipes 34 and 43 and pipes 36 and 40.

Jack 29 is supplied by means of a pump 44 connected to a fluid reservoir 45 by its suction pipe 46 and to a four-positioned valve 47 by its delivery pipe 48. Pipes 49, 50, 51 connect valve 47 respectively to reservoir 45, to large chamber 29*a* and to small chamber 29*b* of jack 29. Finally, a calibrated delivery valve 52 is located on a pipe 53 connected to delivery pipe 48 and to the reservoir 45.

The first position of valve 47 corresponds to connecting pipes 51 and 48 and pipes 50 and 49, the second position to connecting pipes 48 and 49 and the sealing of pipes 50 and 51, the third position to connecting pipes 48, 49, 50 and 51 and the fourth position to connecting pipes 51 and 49 and pipes 48 and 50.

It should also be noted that shafts 19, 20, 23 and 26 substantially coincide with the apices of a parallelogram, arms 10 are substantially vertical, the distances separating shafts 24 and 32 and 26 and 27 are substantially identical, distance 1 separating shafts 23, 24 is substantially identical to the distance L separating shafts 27, 32, the distance *d* separating shafts 26, 27 is substantially identical to the distance D separating articulation shaft 27 from pivot axis X of the chassis 1 relative to the edge of depression 33.

The main advantages of the machine described hereinbefore result from the great robustness of its working equipment, which is well adapted to the function which it fulfils. This great robustness is due to the design of the system of arms in the form of articulated connections. Thus, it is easier to produce good strong articulations than good slides.

However, this working equipment is also very suitable for a drainage function. Thus, with valve 47 in the first position, jack 29 completely released, valve 35 in the second position and jacks 22 locked, the system of arms can deform in the manner shown in FIG. 2 in such a way as to permit chassis 1 to follow local unevennesses of the ground and enter position 1*a*, whilst tooth 5 remains at an average unchanged depth *p* and retains its direction F. Thus, the drain laid by said tooth is correctly positioned. The function of jack 22 is to maintain constant the angle between arms 11 and each of the arms 13.

One of the sought objectives is naturally to make tooth 5 maintain a substantially constant depth *p* relative to the average surface level 3*a* of the ground. If A is the angle by which chassis 1 has been pivoted about axis X coinciding with the edge of depression 33[$A$ = angle (X–27, X–27*a*)], B the rotation angle of each arm 8[$B$ = angle (26–27, 26–27*a*)], shaft 26 connected to tooth 5 assumed not to have moved and C the rotation angle of each arm 13[$C$ = angle (23–24, 23–24*a*)] and shaft 23 connected to tooth 5 also assumed not to have moved the following equations are proved:

$$2D \text{ sine } A/2 = 2\, d \text{ sine } B/2$$

$$2L \text{ sine } A/2 = 2\ 1 \text{ sine } C/2$$

Moreover, when shafts 19, 20, 23 and 26 coincide with the apices of a parallelogram, as in the example shown angles B and C are equal.

In this case, the two above equations are written $D/L = d/1$, because sine $B/2$ = sine $C/2$, whereby this constitutes a condition for depth p remaining constant. Obviously, when the above identity is only obtained in an approximate manner, depth p is only approximately constant.

Thus, in the machine shown, $D=d$ and $L=1$, so that the above-mentioned condition of constancy of depth p is obtained.

Instead of the digging ground 3 it may be desired to use tooth 5 for breaking down a hard point. Valve 47 is then placed in its second position which brings about the locking of jack 29. Thus, the system of arms is rigidified and a very large tensile stress is exerted on tooth 5 in order to break up the said hard point.

It is finally pointed out that when constructing drains, the regulation of the laying depth p of the drain 54 is brought about by acting on jack 22 which makes it possible to modify the configurations of the parallelogram 19, 20, 23, 26 and to rigidify it in such a way that the tooth is driven into the ground 3 to a greater or lesser extent.

The invention is not limited to the embodiment described hereinafter and in fact covers all variants thereof falling within the scope of the present invention.

What is claimed is:

1. Drainage machine apparatus constituted by a structure and by working equipment, said apparatus comprising a tooth mounted on a support and a system of arms articulated about horizontal shafts connecting the support to the structure, wherein the system of arms is formed by first, second and third arms which, in cooperation with the tooth support form an articulated quadrilateral, the first arm being articulated to the support and to the third arm and the third arm also being articulated to the support, wherein the second arm is spaced from the structure, while the first arm is articulated to the structure by a different shaft from that which articulates it to the second arm and the system of arms also comprises fourth and fifth arms articulated to each other wherein additionally the fourth arm is articulated to the third arm and the fifth arm to the structure, and a locking member coupled to the third and fourth arms in such a way as to selectively maintain at a given value the angle formed by the third and fourth arms.

2. Apparatus according to claim 1, wherein the distances between the articulation shafts of on the one hand the first arm to the support and to the structure and on the other hand the fifth arm to the fourth arm and to the structure are substantially identical.

3. Apparatus according to claim 1, wherein a further locking member, such as a hydraulic jack is coupled between the structure and the fifth arm in such a way as to maintain selectively constant the relative orientation of the fifth arm relative to the structure.

4. A machine according to claim 1, wherein the structure is formed in two parts, a chassis and a hinge member which pivots about a shaft which is generally vertical relative to the chassis, the first and fifth arms being articulated to the said hinge member.

5. Apparatus according to claim 1 wherein said quadrilateral is a parallelogram.

* * * * *